US006227929B1

(12) United States Patent
Nelson et al.

(10) Patent No.: US 6,227,929 B1
(45) Date of Patent: May 8, 2001

(54) WHIRLING AMUSEMENT DEVICE AND ASSOCIATED METHOD OF OPERATION

(76) Inventors: Webb Nelson, 19180 144th Ave. NE., Woodinville, WA (US) 98072; Patrick Turner, 2107 25th Ave. SE., Puyallup, WA (US) 98374

( * ) Notice: Subject to any disclaimer, the term of this patent is extended or adjusted under 35 U.S.C. 154(b) by 0 days.

(21) Appl. No.: 09/383,914

(22) Filed: Aug. 26, 1999

(51) Int. Cl.[7] ..... A63H 1/02
(52) U.S. Cl. ..... 446/239; 40/411; 446/236
(58) Field of Search ..... 446/236, 247, 446/219, 239, 241, 260, 266, 464, 175; 40/411, 414

(56) References Cited

U.S. PATENT DOCUMENTS

| | | | | |
|---|---|---|---|---|
| 106,262 | * | 8/1870 | Fine | 446/236 |
| 2,307,905 | * | 1/1943 | Ament . | |
| 2,673,087 | * | 3/1954 | Bacon . | |
| 2,958,144 | * | 11/1960 | Stranges et al. . | |
| 3,545,126 | * | 12/1970 | Brown . | |
| 5,003,714 | * | 4/1991 | Satoh et al. | 40/411 |
| 5,045,014 | | 9/1991 | Harkins | 446/236 |
| 5,078,643 | * | 1/1992 | Thill . | |
| 5,146,702 | * | 9/1992 | Belokin . | |
| 5,209,692 | * | 5/1993 | Coleman et al. | 446/236 |
| 5,536,054 | * | 7/1996 | Liaw | 446/236 |
| 5,609,509 | * | 3/1997 | Stamos . | |
| 5,823,844 | * | 10/1998 | Markowitz | 446/175 |
| 5,826,997 | * | 10/1998 | Coleman et al. . | |
| 5,890,946 | | 4/1999 | Bloomfield | 446/236 |
| 5,902,167 | * | 5/1999 | Filo et al. | 446/404 |
| 5,971,829 | * | 10/1999 | Hartman | 446/236 |
| 6,004,597 | * | 12/1999 | Coleman et al. . | |

* cited by examiner

*Primary Examiner*—Sam Rimell
(74) *Attorney, Agent, or Firm*—LaMorte & Associates P.C.

(57) ABSTRACT

An amusement device used to move a supported display object through an erratic path. The amusement device includes a base element in which is disposed a rotating assembly. The rotating assembly can be battery powered, spring powered or manually powered. A support spring is used to interconnect a display object to the rotating assembly in the base element. The support spring has a first end and a second end. The first end of the support spring is coupled to the rotating assembly within the base element, wherein the support spring is rotated by the rotating assembly. The remainder of the support spring extends freely from the base element. The display object is coupled to the second end of the support spring. As the display object rotates, it causes the support spring to at least partially elongate, thereby causing the display object to move erratically from point to point.

13 Claims, 4 Drawing Sheets

WHIRLING AMUSEMENT DEVICE AND ASSOCIATED METHOD OF OPERATION

BACKGROUND OF THE INVENTION

1. Field of the Invention

The present invention relates to amusement devices that contain an object that spins or whirls. More particularly, the present invention relates to amusement devices that contain an object that spins, a motor for spinning that object and a flexible shaft disposed between the object and the motor.

2. Description of the Prior Art

The prior art of toys and amusement devices is replete with many examples of objects that spin and whirl. Many such devices are powered by rotational momentum, such as tops and gyroscopes. Other devices are powered by springs, such as windup ballerina figures. Still many other devices utilize battery powered motors to create a spinning motion.

One variation of a battery powered amusement device is when the object being spun is connected to the battery powered motor by a flexible shaft. In such devices, the forces of inertia and centrifugal force cause the flexible shaft to oscillate as the shaft spins. The oscillation of the shaft causes the object being spun to move in an erratic manner. Such prior art devices are exemplified by U.S. Pat. No. 5,146,702 to Belokin, entitled, Display Having An Electric Motor For Simulating A Flying Object; U.S. Pat. No. 4,100,697 to Ward, entitled, Hoop Top; and U.S. Pat. No. 5,823,844 to Markowitz, entitled, Interactive Vibrating Toy.

A limitation associated with such prior art amusement devices is the fact that the length of the flexible shaft is constant. As such, the object supported by the flexible shaft is restrained by the flexible shaft should that object attempt to move away from or closer to the rotating base.

It has been found that an the path followed by a rotating object is far more complex and interesting to observe if the length of the shaft supporting that object is not held constant. It is therefore an object of the present invention to provide an amusement device where an object is held at the end of a rotating flexible shaft that has a variable length. In this manner, the object is free to move both toward and away from its rotating base as part of its erratic movement.

SUMMARY OF THE INVENTION

The present invention is an amusement device used to move a supported display object through an erratic path. The amusement device includes a base element in which is disposed a rotating assembly. The rotating assembly can be battery powered, spring powered or manually powered. A support spring is used to interconnect a display object to the rotating assembly in the base element. The support spring has a first end and a second end. The first end of the support spring is coupled to the rotating assembly within the base element, wherein the support spring is rotated by the rotating assembly. The remainder of the support spring extends freely from the base element.

The display object is coupled to the second end of the support spring. As the display object rotates, it causes the support spring to at least partially elongate, thereby causing the display object to move erratically from point to point.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE INVENTION

Figure 1:
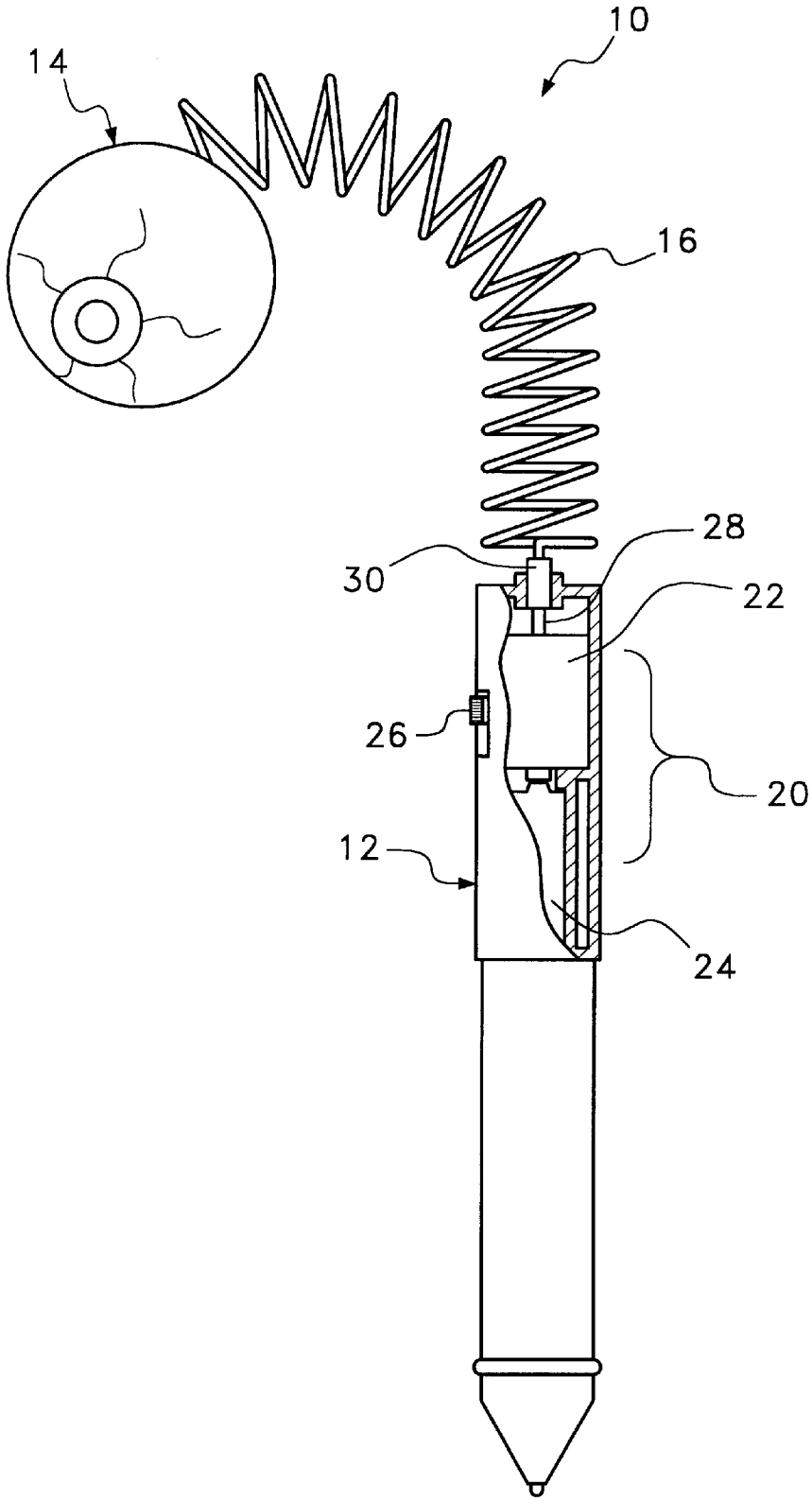
FIG. 1 is a partially fragmented front view of a first embodiment of the present invention amusement device.

Referring to FIG. 1, an exemplary embodiment of the present invention device 10 is shown. The device is comprised of three primary parts, which are a base 12, a display object 14 and a support spring 16 that interconnects the display object 14 to the base 12.

In the shown embodiment, the base 12 is configured as a pen. However, such an embodiment is merely exemplary. The base 12 can be most any hand held object. Alternatively, the base 12 can be a self-supporting structure that can rest on a flat surface. As such, it should be understood that the appearance of the base 12 is not important to the functioning of the overall device 10. The base 12 can be dedicated to the function of the overall device 10 or the base 12 can have a secondary purpose outside the functioning of the overall device 10, as does the pen illustrated. Alternate embodiments of the base are later described.

Regardless of the appearance of the base 12, contained within the base is rotating assembly 20. Preferably, the rotating assembly 20 includes a motor 22, a battery 24 for powering the motor 22 and an on/off switch 26 for controlling the operation of the motor 22, as is shown in FIG. 1. However, in alternate embodiments, the rotating assembly 20 can be a spring wound assembly, a flywheel assembly, a manual crank assembly or any other known means for providing rotational movement at a predetermined point in an amusement device. The rotating assembly 20 rotates the support spring 16 that extends from the base 12.

In the shown embodiment of the rotating assembly, the motor 22 turns a drive shaft 28. The drive shaft 28 terminates with a connector coupling 30 that can be accessed externally from the base 12. As is shown, the motor 22 directly turns the connector coupling 30, via the drive shaft 28. However, it will be understood that gearing can be present between the motor 22 and the connector coupling 30 that alters the rotation rate of the connector coupling 30 with respect to the motor 22. Such gearing is well known and used in the field of motorized toys.

The support spring 16 is a coil spring having a relatively low spring constant. The spring constant is selected so that the support spring 16 is just capable of maintaining full compression when stacked vertically with the weight of the display object 14 aligned vertically at its top. Once the support spring 16 is turned away from a vertical alignment, the weight of the display object 14 bends the support spring 16 and pulls the support spring 16 away from full compression. The support spring 16 can be made from either plastic or metal, as desired.

The support spring 16 has two ends. One end of the support spring 16 attaches to the connector coupling 30 on the base 12. A connector may be present at the end of the support spring 16 to facilitate attachment between the support spring 16 and the connector coupling 30.

The opposite end of the support spring 16 terminates with the display object 14. The display object 14 can be either permanently affixed to the support spring 16 or detachable from the support spring 16. A detachable configuration can be used in assemblies where multiple display objects are available and a person selects which of the display objects is placed upon the support spring 16.

The display object 14 can be any item desired. However, since the display object 14 will whirl around in an erratic pattern, it is desired that the display object 14 have no sharp points and be light in weight, so as to prevent injuries if the display object were to inadvertently contact a person's face.

In the shown embodiment, the display object 14 is an eyeball made from photoluminescent plastic that enables the eyeball to be viewed in the dark. It will be understood that the display object 14 can be any object, such as an airplane, an insect, a cartoon character or the like. The display object 14 can also be a confection such as a hard candy.

Figure 2:
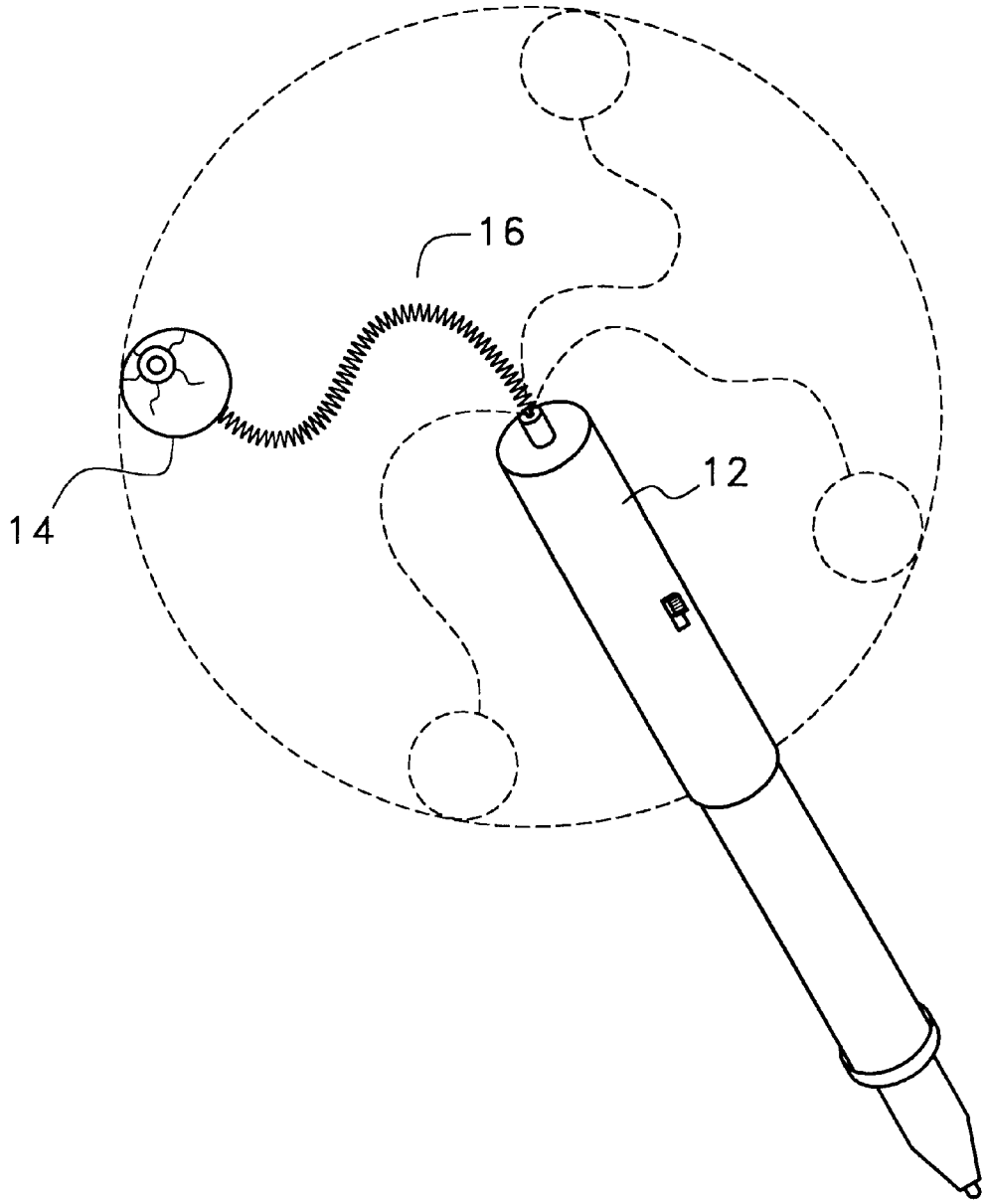
FIG. 2 is a perspective view of the embodiment of the present invention amusement device shown in FIG. 1.

Referring to FIG. 2, it can be seen that the support spring 16 is rotated by the motor 22 (FIG. 1) in the base 12. During rotation, the inertia and centrifugal force created by the combined mass of the support spring 16 and the display object 14, causes the support spring 16 to elongate and the display object 14 to move erratically. As the display object 14 moves, the support spring 16 stretches and retracts, thereby altering the length of the support spring 16. The forces created by the deformed support spring 16 combine with the inertial and centrifugal forces to rapidly vary the movements of the display object 14.

The display object 14 erratically moves to different points throughout a possible range, which is shown by the circle in FIG. 2. The possible range is spherical in shape and has a radius equal to the stretched length of the support spring 16. If the forces experienced by the support spring 16 are insufficient to fully extend the support spring 16, the radius of the possible range will decrease to the maximum length at which the support spring is stretched.

Figure 3:
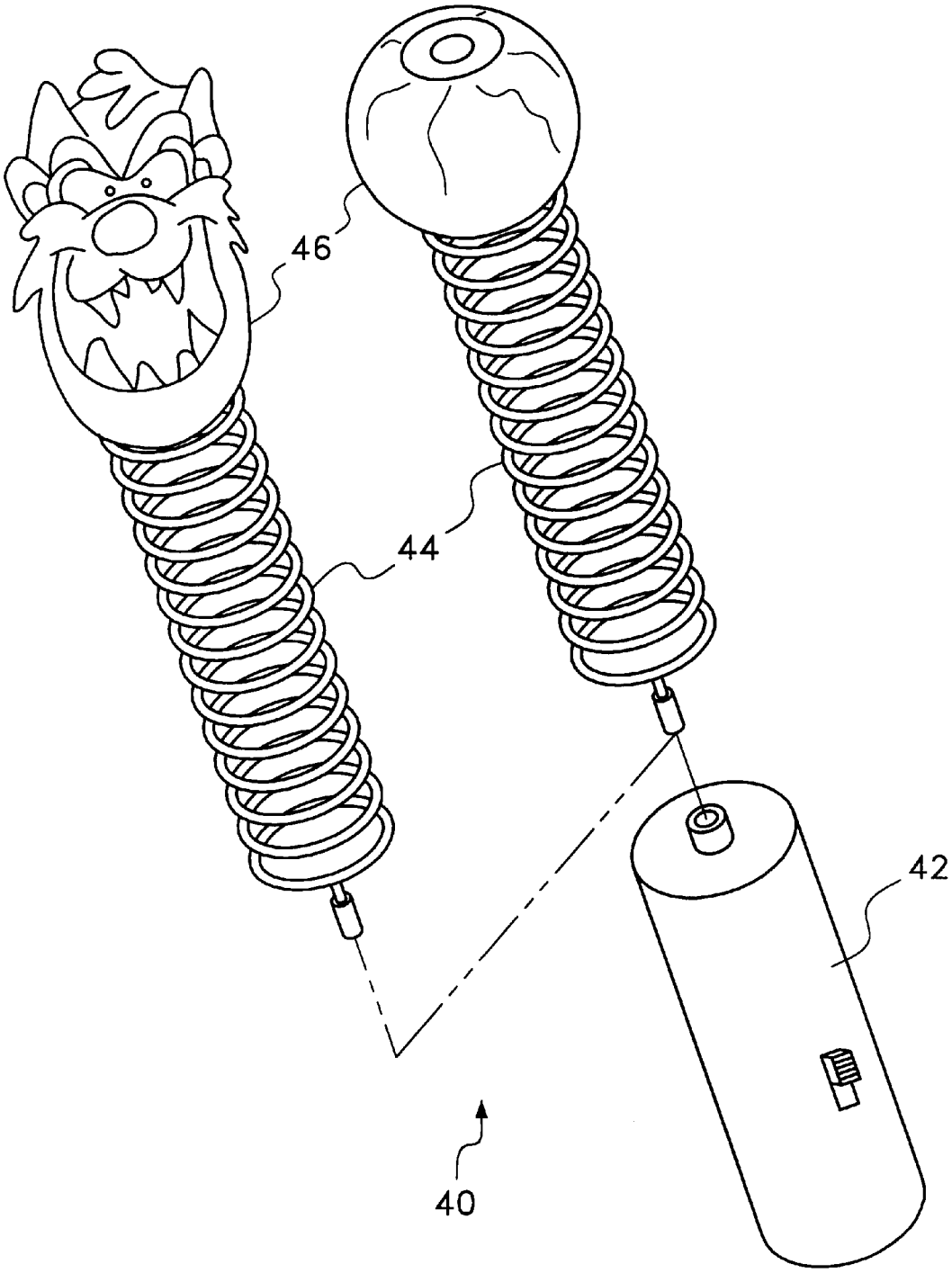
FIG. 3 is a perspective view of an alternate embodiment of the present invention amusement device.

Referring to FIG. 3, a variation of the present invention device 40 is shown. In this embodiment, the base 42 is a self-contained hand-held unit. The base 40 may even be a pre-existing assembly, such as battery operated lollipop holder. Battery operated lollipop holders are exemplified by U.S. Pat. No. 5,209,692 to Coleman, entitled, Combination Novelty Toy And A Candy Holding Device, the disclosure of which is incorporated into this specification by reference.

However, from FIG. 3, it can be seen that multiple support springs 44 and multiple display objects 46 can be supplied. The different support springs 44 can have different lengths, different coil diameters and different spring constants. As such, each type of support spring 44 will move in its own unique manner.

The display objects 46 also can be come in a variety of sizes and weights. Since size and weight effect the path followed by the display object 46, each type of display object 46 will have its own unique movement characteristics.

Figure 4:
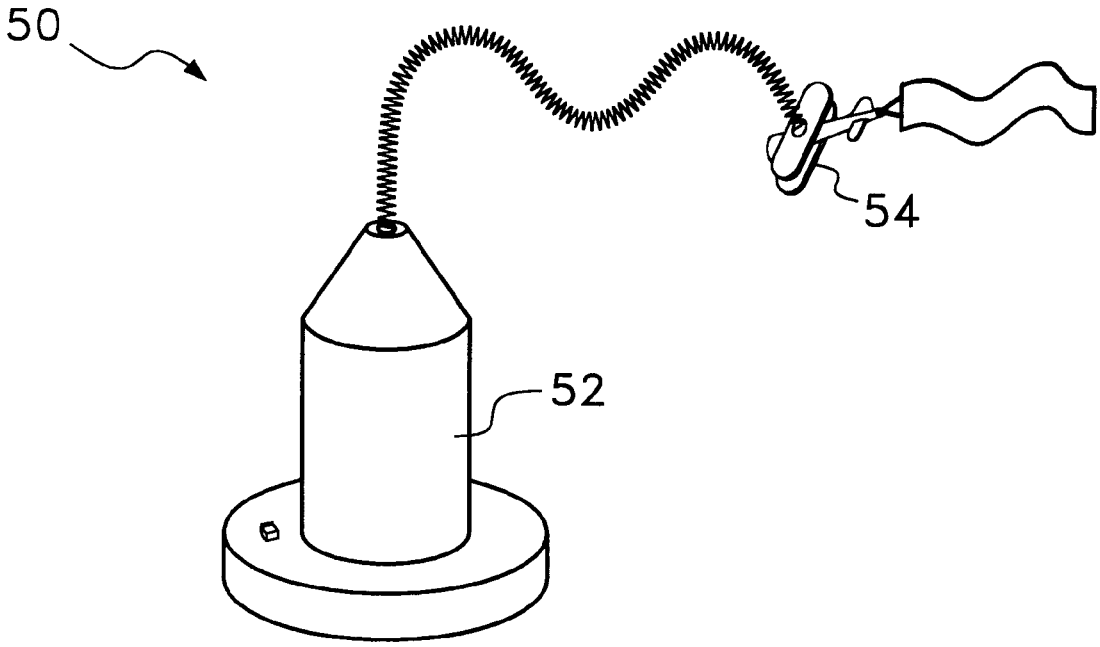
FIG. 4 is a perspective view of third alternate embodiment of the present invention amusement device.

Referring lastly, to FIG. 4, another embodiment of the present invention device 50 is disclosed. In this embodiment, the base 52 is a self-supporting assembly that can rest on a flat surface and does not need to be held. As such, the display object 54 will whirl around the base 52 as the base 52 rests on a surface. Such a configuration can be used as an advertisement promotion to attract the attention of customers. Such a configuration is also useful as part of a game, wherein a whirling display object 54 is used to knock down objects or is used to combat other whirling objects.

It will be understood that the various figures described above illustrate only preferred embodiments of the present invention. Features from the different embodiments can be mixed to produce yet further embodiments. A person skilled in the art can therefore make numerous alterations and modifications to the shown embodiments utilizing functionally equivalent components to those shown and described. All such modifications are intended to be included within the scope of the present invention as defined by the appended claims.

What is claimed is:

1. An amusement device, comprising:

a pen having a front section and a rear section, wherein said front section of said pen functions as a pen;

a rotating assembly disposed in said rear section of said pen;

a coil spring having one end coupled to said rotating assembly, wherein and said coil spring is rotated by said rotating assembly;

a display object coupled to said coil spring, said coil spring being the sole support of said display object, wherein said display object has a mass sufficient to partially elongate said coil spring when said coil spring is in an orientation other than vertical.

2. The device according to claim 1, wherein said rotating assembly includes an electric motor.

3. The device according to claim 1, wherein said rotating assembly is selected from a group consisting of spring wound assemblies, flywheel assemblies and hand cranked assemblies.

4. The device according to claim 2, further including an on/off switch accessible on said pen for selectively activating and deactivating said electric motor.

5. The device according to claim 1, wherein said coil spring is selectively detachable from said rotating assembly.

6. The device according to claim 1, wherein said coil spring is selectively detachable from said display object.

7. The device according to claim 1, wherein said display object is photoluminescent.

8. The device according to claim 1, wherein said display object is a confection.

9. The device according to claim 1, wherein said base element has a flat bottom surface and is free standing on said flat bottom surface.

10. A method of imparting erratic movement to an object, comprising the steps of:

providing a pen having a rotating assembly contained therein;

providing a coil spring having a first end and a second end;

attaching said object to said coil spring;

attaching said coil spring to said rotating assembly in said pen;

rotating said coil spring and said object at a speed sufficient to at least partially elongate said coil spring.

11. The method according to claim 10, wherein said rotating assembly includes an electric motor.

12. The method according to claim 10, wherein said rotating assembly is selected from a group consisting of spring wound assemblies, flywheel assemblies and hand cranked assemblies.

13. The method according to claim 10, wherein said object has a mass sufficient to partially elongate said coil spring when said coil spring is in an orientation other than vertical.

* * * * *